US007587769B1

(12) United States Patent
McDermott

(10) Patent No.: US 7,587,769 B1
(45) Date of Patent: Sep. 15, 2009

(54) SWADDLING ARTICLE

(76) Inventor: Julie McDermott, 887 W. Glenmere Dr., Chandler, AZ (US) 85225

( * ) Notice: Subject to any disclaimer, the term of this patent is extended or adjusted under 35 U.S.C. 154(b) by 0 days.

(21) Appl. No.: 11/844,234

(22) Filed: Aug. 23, 2007

(51) Int. Cl.
*A47G 9/00* (2006.01)
*A41B 13/06* (2006.01)

(52) U.S. Cl. ..... 5/494; 5/482; 5/655; 2/69

(58) Field of Classification Search ..... 5/494, 5/482, 655, 413 R; 2/69, 69.5
See application file for complete search history.

(56) References Cited

U.S. PATENT DOCUMENTS

| | | | | | |
|---|---|---|---|---|---|
| 1,802,540 | A * | 4/1931 | Schmidt | ..... | 2/114 |
| 5,131,096 | A * | 7/1992 | Olson | ..... | 2/75 |
| 5,147,384 | A * | 9/1992 | La Rocca | ..... | 606/234 |
| 5,245,717 | A * | 9/1993 | Rudy | ..... | 5/507.1 |
| 5,263,975 | A | 11/1993 | La Rocca | | |
| 5,908,439 | A * | 6/1999 | Ford et al. | ..... | 606/234 |
| 6,269,502 | B1 | 8/2001 | Exstrom | | |
| 6,292,962 | B1 | 9/2001 | Dunn et al. | | |
| 6,393,612 | B1 * | 5/2002 | Thach et al. | ..... | 2/69.5 |
| 6,513,164 | B1 * | 2/2003 | Hearns | ..... | 2/69.5 |
| 6,868,566 | B2 | 3/2005 | Gatten | | |
| 6,978,479 | B2 * | 12/2005 | Thach | ..... | 2/69.5 |
| 7,181,789 | B2 * | 2/2007 | Gatten | ..... | 5/494 |
| 2002/0026670 | A1 * | 3/2002 | Dunn et al. | ..... | 5/482 |
| 2002/0129445 | A1 * | 9/2002 | Deering et al. | ..... | 5/482 |
| 2002/0129447 | A1 * | 9/2002 | Dunn et al. | ..... | 5/655 |
| 2005/0262633 | A1 * | 12/2005 | Haleem | ..... | 5/482 |
| 2006/0200906 | A1 * | 9/2006 | Deering et al. | ..... | 5/482 |

* cited by examiner

*Primary Examiner*—Robert G Santos
(74) *Attorney, Agent, or Firm*—Parsons & Goltry; Michael W. Goltry; Robert A. Parsons

(57) ABSTRACT

An article for swaddling a baby includes a blanket formed with opposed arm-receiving sleeves. The blanket incorporates a pacifier retaining structure, which is formed in the blanket between an outer edge of the blanket and one of the opposed arm-receiving openings and which is for receiving and retainer a pacifier relative to the blanket.

22 Claims, 8 Drawing Sheets

SWADDLING ARTICLE

FIELD OF THE INVENTION

The present invention relates to articles of dress and clothing for babies and, more particularly, swaddling blankets.

BACKGROUND OF THE INVENTION

The practice of baby swaddling dates back centuries, and is still common in many cultures. Swaddling involves tightly wrapping a baby securely from shoulders to feet with a small blanket.

Swaddling is useful for soothing and calming a fussy baby. Many believe that a tightly enwrapped baby feels secure because it represents a facsimile of being in the womb. Swaddling also keeps a baby warm, which is important because a newborn cannot regulate body temperature as well as an adult. Swaddling also helps newborns sleep longer because it prevents sudden movements that can cause waking. Other benefits of swaddling are also apparent. For instance, swaddling helps restrain a baby's arms and legs keeping them out of the way of breastfeeding and making the baby easier to hold, and prevents a baby, who has limited control over his arm and leg movements, from scratching himself with his nails.

Some babies need to adjust to swaddling in the beginning. Accordingly, babies must be given the chance to become comfortable with swaddling before the practice is abandoned. If a baby does not seem to like swaddling, it is recommended that one or both of his arms be left free. Proper swaddling, however, requires that the blanket fit snugly, but not so tightly as to impede blood circulation. Swaddling usually works well for babies from birth to about three or four months of age. However, babies who are used to swaddling may enjoy it for a longer period of time.

Swaddling is, accordingly, best characterized as tightly enwrapping a baby from shoulders to feet with a small blanket. One problem with swaddling a baby from shoulders to feet is that the baby must be un-swaddled in order to change the baby's diaper, which is frustrating and time-consuming, and which typically causes a sleeping baby to awaken unnecessarily. Furthermore, through normal movement a swaddled baby invariable can loosen the swaddle provided by the blanket and scratch himself with his nails or awaken from sleep. Accordingly, given the benefits of swaddling and the shortcomings of using a small blanket to swaddle a baby, the need for improvement in the field of swaddling blankets is evident.

SUMMARY OF THE INVENTION

According to the invention, an article for swaddling a baby includes a soft, pliant blanket having opposed upper and lower edges, opposed first and second side edges, an outer face and an opposed inner face defining a body-receiving area between the first and second sides edges of the blanket extending from the upper edge of the blanket to the lower edge of the blanket. The blanket is formed with opposed, spaced apart first and second arm-receiving sleeves. The first arm-receiving sleeve is disposed between the opposed upper and lower edges of the blanket and between the body-receiving area of the inner face of the blanket and the first side edge of the blanket. The second arm-receiving sleeve is disposed between the opposed upper and lower edges of the blanket and between the body-receiving area of the inner face of the blanket and the first side edge of the blanket. The first arm-receiving sleeve is substantially parallel relative to the upper edge of the blanket. The second arm-receiving sleeve is substantially parallel relative to the upper edge of the blanket. The first arm-receiving sleeve has a first proximal end directed toward the body-receiving area of the inner face of the blanket, and a first distal end directed toward the first side edge of the blanket. A first flap of the blanket extends from the first distal end of the first arm-receiving sleeve to the first side edge of the blanket. The second arm-receiving sleeve has a second proximal end directed toward the body-receiving area of the inner face of the blanket, and a second distal end directed toward the second side edge of the blanket. A second flap of the blanket extends from the second distal end of the second arm-receiving sleeve to the second side edge of the blanket. Pacifier retaining structure is formed in the blanket between the upper edge of the blanket and the first arm-receiving sleeve for receiving and retainer a pacifier relative to the blanket. A pacifier includes a nipple, and in a particular embodiment the pacifier is retained by the pacifier retaining structure maintaining the nipple extending away from the inner face of the blanket.

According to the invention, an article for swaddling a baby includes a soft, pliant blanket having opposed upper and lower edges, opposed first and second side edges, an outer face and an opposed inner face defining a body-receiving area between the first and second sides edges of the blanket extending from the upper edge of the blanket to the lower edge of the blanket. The blanket is formed with opposed, spaced apart first and second arm-receiving sleeves. The first arm-receiving sleeve is disposed between the opposed upper and lower edges of the blanket and between the body-receiving area of the inner face of the blanket and the first side edge of the blanket. The second arm-receiving sleeve is disposed between the opposed upper and lower edges of the blanket and between the body-receiving area of the inner face of the blanket and the first side edge of the blanket. A first pacifier receiving opening is formed through the blanket between the upper edge of the blanket and the first arm-receiving sleeve. A pacifier includes a pacifier body and a nipple attached to, and extending away from, the pacifier body. In one embodiment, the pacifier received and held by the pacifier receiving opening. In another embodiment, the body of the pacifier is disposed against the outer face of the blanket, and the nipple extends away from the inner face of the blanket through the first pacifier receiving opening. The first arm-receiving sleeve is substantially parallel relative to the upper edge of the blanket, and the second arm-receiving sleeve is substantially parallel relative to the upper edge of the blanket. The first arm-receiving sleeve has a first proximal end directed toward the body-receiving area of the inner face of the blanket, and a first distal end directed toward the first side edge of the blanket. A first flap of the blanket extends from the first distal end of the first arm-receiving sleeve to the first side edge of the blanket. The second arm-receiving sleeve has a second proximal end directed toward the body-receiving area of the inner face of the blanket, and a second distal end directed toward the second side edge of the blanket. A second flap of the blanket extends from the second distal end of the second arm-receiving sleeve to the second side edge of the blanket. A plurality of spaced-apart pacifier receiving openings is formed through the blanket between the upper edge of the blanket and the first arm-receiving sleeve, and the first pacifier receiving opening includes one of the plurality of spaced-apart pacifier receiving openings. The plurality of spaced-apart pacifier receiving openings is formed in a row substantially parallel to the first arm-receiving sleeve.

According to the invention, an article for swaddling a baby includes a soft, pliant blanket having opposed upper and lower edges, opposed first and second side edges, an outer face and an opposed inner face defining a body-receiving area between the first and second sides edges of the blanket extending from the upper edge of the blanket to the lower edge of the blanket. The blanket is formed with opposed, spaced apart first and second arm-receiving sleeves. The first arm-receiving sleeve is disposed between the opposed upper and lower edges of the blanket and between the body-receiving area of the inner face of the blanket and the first side edge of the blanket. The second arm-receiving sleeve is disposed between the opposed upper and lower edges of the blanket and between the body-receiving area of the inner face of the blanket and the first side edge of the blanket. The blanket is formed with a pacifier body-receiving pocket disposed between the upper edge of the blanket and the first arm-receiving sleeve. A first pacifier receiving opening is formed through the pocket from the inner face of the blanket. A pacifier includes a pacifier body and a nipple attached to, and extending away from, the pacifier body, the body is disposed in the pacifier body-receiving pocket, and the nipple extends away from the inner face of the blanket through the first pacifier receiving opening. The first arm-receiving sleeve is substantially parallel relative to the upper edge of the blanket. The second arm-receiving sleeve is substantially parallel relative to the upper edge of the blanket. The first arm-receiving sleeve has a first proximal end directed toward the body-receiving area of the inner face of the blanket, and a first distal end directed toward the first side edge of the blanket. A first flap of the blanket extends from the first distal end of the first arm-receiving sleeve to the first side edge of the blanket. The second arm-receiving sleeve has a second proximal end directed toward the body-receiving area of the inner face of the blanket, and a second distal end directed toward the second side edge of the blanket. A second flap of the blanket extends from the second distal end of the second arm-receiving sleeve to the second side edge of the blanket. A plurality of spaced-apart pacifier receiving openings is formed through the pocket from the inner face of the blanket, and the first pacifier receiving opening is one of the plurality of spaced-apart pacifier receiving openings. The plurality of spaced-apart pacifier receiving openings is formed in a row substantially parallel to the first arm-receiving sleeve.

Consistent with the foregoing summary of preferred embodiments, and the ensuing detailed description, which are to be taken together, the invention also contemplates associated embodiments.

BRIEF DESCRIPTION OF THE DRAWINGS

Referring to the drawings.

DETAILED DESCRIPTION OF PREFERRED EMBODIMENTS

Figure 1:
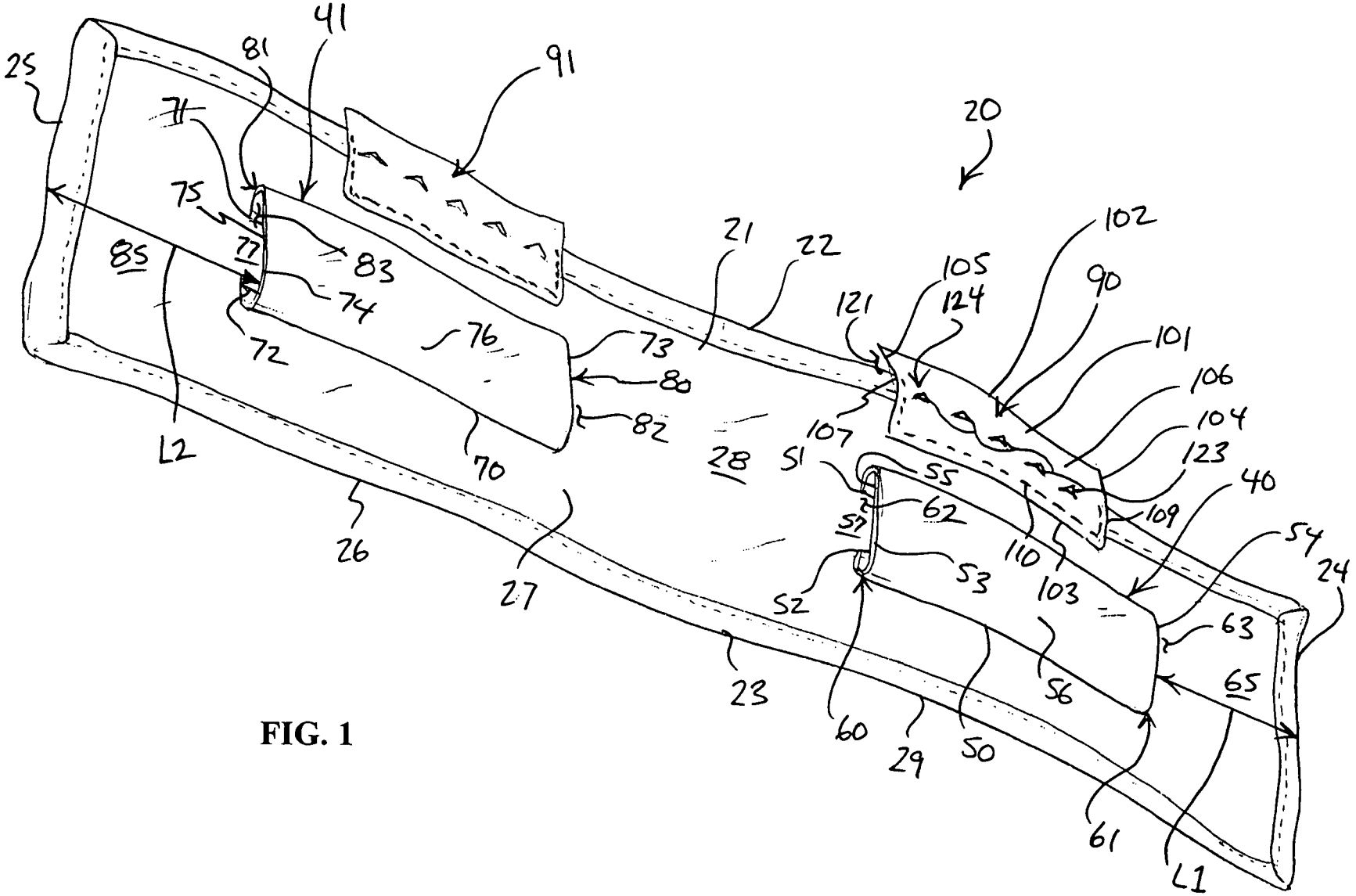
FIG. 1 is a perspective view of a swaddling article constructed and arranged in accordance with the principle of the invention.

Turning now to the drawings, in which like reference characters indicate corresponding elements throughout the several views, attention is first directed to FIG. 1 in which there is seen a perspective view of a swaddling article 20 constructed and arranged in accordance with the principle of the invention including a soft, broad, flat, pliant blanket 21 having opposed upper and lower edges 22 and 23, opposed side edges 24 and 25, an outer face 26, and an opposed inner face 27, which defines a body-receiving surface or area 28 between sides edges 24 and 25 of blanket 21 extending from upper edge 22 of blanket 21 to lower edge 23 of blanket 21. Outer and inner faces 26 and 27 are opposed, coextensive major faces of blanket 21. Upper edge 22 is substantially parallel relative to lower edge 23, side edge 24 is substantially parallel relative to side edge 25, and upper and lower edges 22 and 23 are substantially parallel relative to side edges 24 and 25. Edges 22-25 are each hemmed in the present embodiment and each has a length, and cooperate together forming a perimeter 29 of blanket 21. In the present embodiment, perimeter 29 is generally rectangular in shape, in which blanket 21 is overall generally rectangular in shape. In this respect, the lengths of upper and lower edges 22 and 23 are substantially equal, and the lengths of side edges 24 and 25 are substantially equal and much shorter than the lengths of upper and lower edges 22 and 23 as illustrated. Blanket 21 is formed of soft, pliant woven or unwoven material, such as cotton, polyester, fleece material, or the like or a selected combination of such materials or other similar materials.

Blanket 21 is formed with opposed, spaced-apart arm-receiving sleeves 40 and 41, in accordance with the principle of the invention. In the present embodiment, sleeved 40 and 41 are formed at inner face 27. Sleeve 40 is elongate and is disposed between upper and lower edges 22 and 23 of blanket 21 and between body-receiving area 28 of inner face 27 of blanket 21 and side edge 24 of blanket 21. Sleeve 41 is elongate and is disposed between upper and lower edges 22 and 23 of blanket 21 and between body-receiving area 28 of inner face 27 of blanket 21 and side edge 25 of blanket 21. Sleeves 40 and 41 opposed one another, and are spaced-apart relative to each other each being disposed on either side of body-receiving area 28. Sleeves 40 and 41 are provided to receive the arms of a baby positioned back first against body-receiving area 28 of blanket 21, in which instance sleeve 40 is to receive the right arm of the baby and sleeve 41 is to receive the left arm of the baby. Sleeve 40 is substantially parallel relative to upper edge 22 of blanket 21, and also lower edge 23 of blanket 21. Sleeve 41 is substantially parallel relative to upper edge 22 of blanket 21, and also lower edge 23 of blanket 21. Sleeves 40 and 41 are each located substantially centrally between upper and lower edges 22 and 23 of blanket 21.

Figure 3:
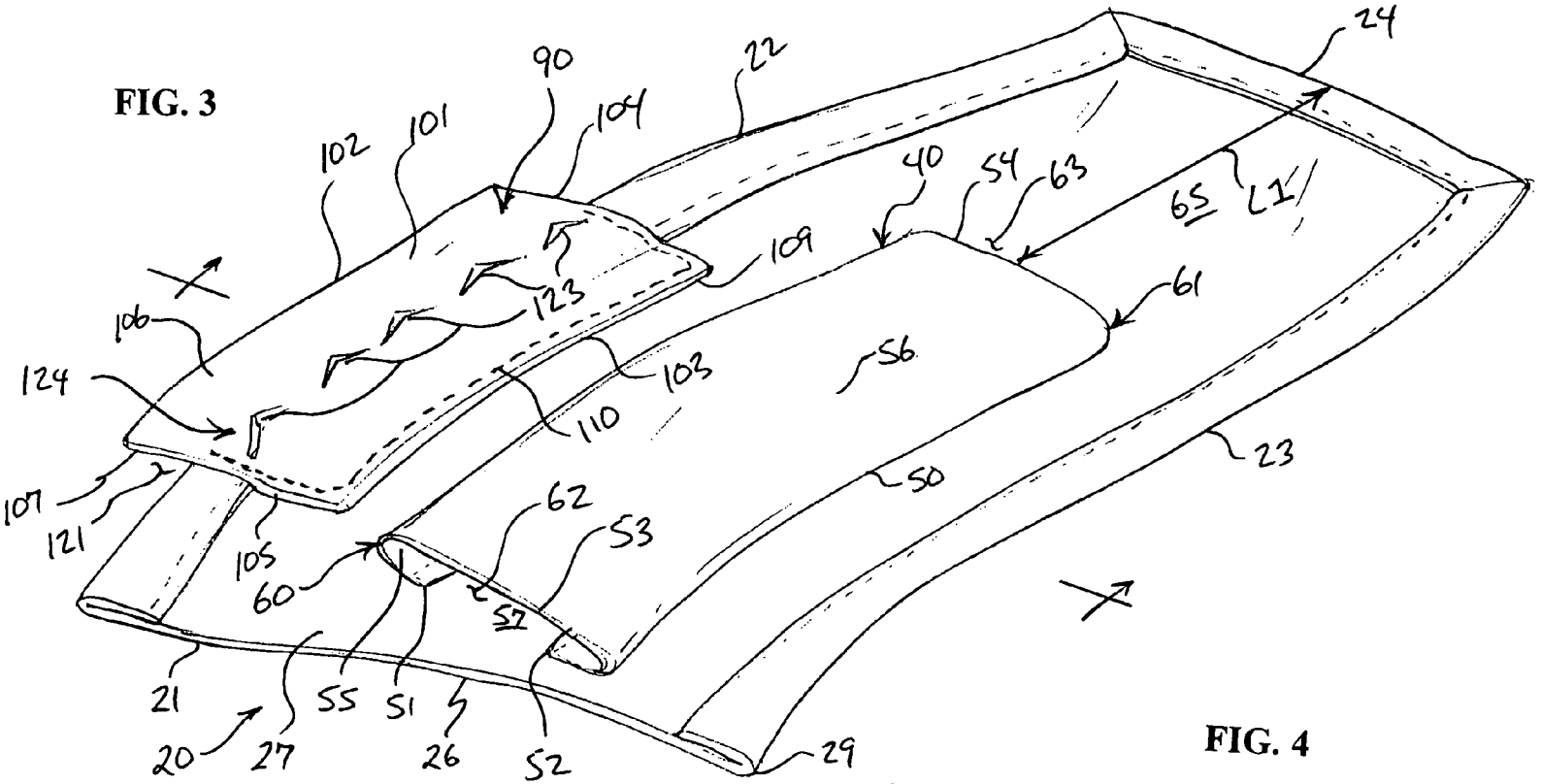
FIG. 3 is an enlarged fragmented perspective view of the swaddling article of FIG. 1.

Referencing FIGS. 1 and 3, in this specific embodiment, sleeve 40 is formed by an elongate, rectangular piece of material 50 having opposed upper and lower end edges 51 and 52, opposed side edges 53 and 54, and opposed inner and outer surfaces 55 and 56. End edges 51 and 52 are applied to inner face 27 of blanket 21, which is also viewed in FIG. 4, and are each secured with stitching and/or a suitable fabric adhesive. End edges 51 and 52 are spaced-apart, are substantially parallel relative to each other, and are each substantially parallel to upper edge 22 of blanket 21 and lower edge 23 of blanket 21. Piece of material 50 extends away from inner face 27 of blanket 21, and inner surface 55 confronts and cooperates with inner face 27 of blanket 21 forming an arm-receiving channel 57 referenced in FIG. 4.

Looking to FIGS. 1 and 3, sleeve 40 has a proximal end denoted generally at 60 and an opposed distal end denoted generally at 61. Proximal end 60 of sleeve 40 is directed toward body-receiving area 28 of inner face 27 of blanket 21, and distal end 61 is directed toward side edge 24 of blanket 21. An opening 62 into channel 57, which is formed by the cooperation between side edge 53 and the confronting portion of inner face 27 of blanket 21, defines proximal end 60 of sleeve 40. An opening 63 into channel 57, which is formed by the cooperation between side edge 54 and the confronting portion of inner face 27 of blanket 21, defines distal end 61 of sleeve 40. Arm-receiving channel 57 extends from proximal end 60 to distal end 61, and is to receive an arm of a baby extending into channel 57 through opening 62 into channel 57 formed at proximal end 60. If desired, distal end 61 of sleeve 40 may be closed. A length L1 of blanket 21 extends from distal end 61 of sleeve 40 to side edge 24 between upper and lower edges 22 and 23. Length L1 of blanket 21 constitutes a flap 65 of blanket 21, in accordance with the principle of the invention.

Like sleeve 40, in this particular embodiment sleeve 41, as viewed in FIG. 1, is formed by an elongate, rectangular piece of material 70 having opposed upper and lower end edges 71 and 72, opposed side edges 73 and 74, and opposed inner and outer surfaces 75 and 76. End edges 71 and 72 are applied to inner face 27 of blanket 21, which is also viewed in FIG. 4, and are each secured with stitching and/or a suitable fabric adhesive. End edges 71 and 72 are spaced-apart, are substantially parallel relative to each other, and are each substantially parallel to upper edge 22 of blanket 21 and lower edge 23 of blanket 21. Piece of material 70 extends away from inner face 27 of blanket 21, and inner surface 75 confronts and cooperates with inner face 27 of blanket 21 forming an arm-receiving channel 77.

Looking to FIGS. 1 and 3, sleeve 41 has a proximal end denoted generally at 80 and an opposed distal end denoted generally at 81. Proximal end 80 of sleeve 41 is directed toward body-receiving area 28 of inner face 27 of blanket 21, and distal end 81 is directed toward side edge 25 of blanket 21. An opening 82 into channel 77, which is formed by the cooperation between side edge 73 and the confronting portion of inner face 27 of blanket 21, defines proximal end 80 of sleeve 41. An opening 83 into channel 77, which is formed by the cooperation between side edge 74 and the confronting portion of inner face 27 of blanket 21, defines distal end 81 of sleeve 41. Arm-receiving channel 77 extends from proximal end 80 to distal end 81, and is to receive an arm of a baby extending into channel 77 through opening 82 into channel 77 formed at proximal end 80. If desired, distal end 81 of sleeve 41 may be closed. A length L2 of blanket 21 extends from distal end 81 of sleeve 41 to side edge 25 between upper and lower edges 22 and 23. Length L2 of blanket 21 constitutes a flap 85 of blanket 21.

With continuing reference to FIGS. 1 and 3, a pacifier retaining structure 90 is formed in blanket 21 adjacent to sleeve 40 proximate to upper edge 22, and a pacifier retaining structure 91 is formed in blanket 21 adjacent to sleeve 41 proximate to upper edge 22. Pacifier retaining structure 90 relates to sleeve 40 and is adapted to receive and retain a pacifier relative to blanket 21 proximate to sleeve 40, in accordance with the principle of the invention. Pacifier retaining structure 91 relates to sleeve 41 and is adapted to receive and retain a pacifier relative to blanket 21 proximate to sleeve 41, in accordance with the principle of the invention. Pacifier retaining structures 90 and 91 are identical, and functional attributes of pacifier retaining structure 90 is discussed below, with the understanding that the ensuing discussion of pacifier retaining structure 90 applies in every respect to pacifier retaining structure 91.

Figure 4:
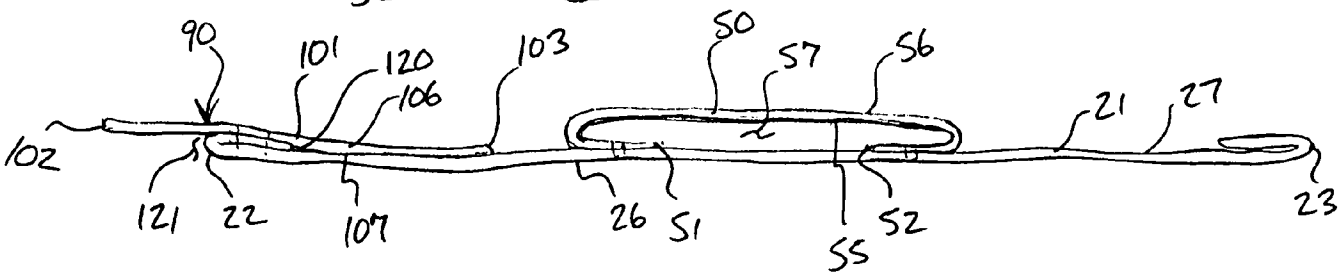
FIG. 4 is a sectional view taken along line 4-4 of FIG. 3.
Figure 5:
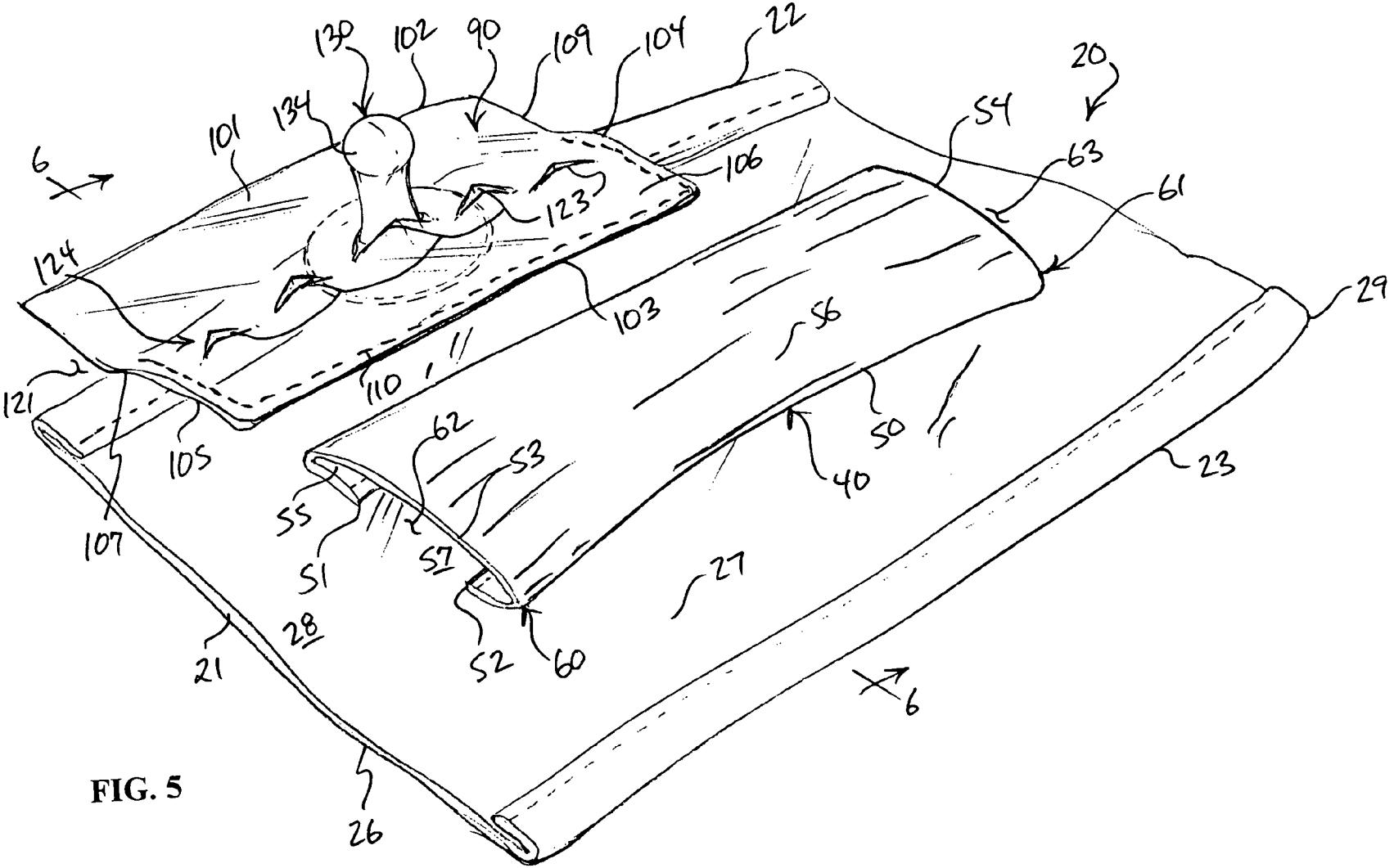
FIG. 5 is a view very similar to the view of FIG. 3 illustrating a pacifier held by a pacifier retaining structure of the swaddling article.
Figure 6:
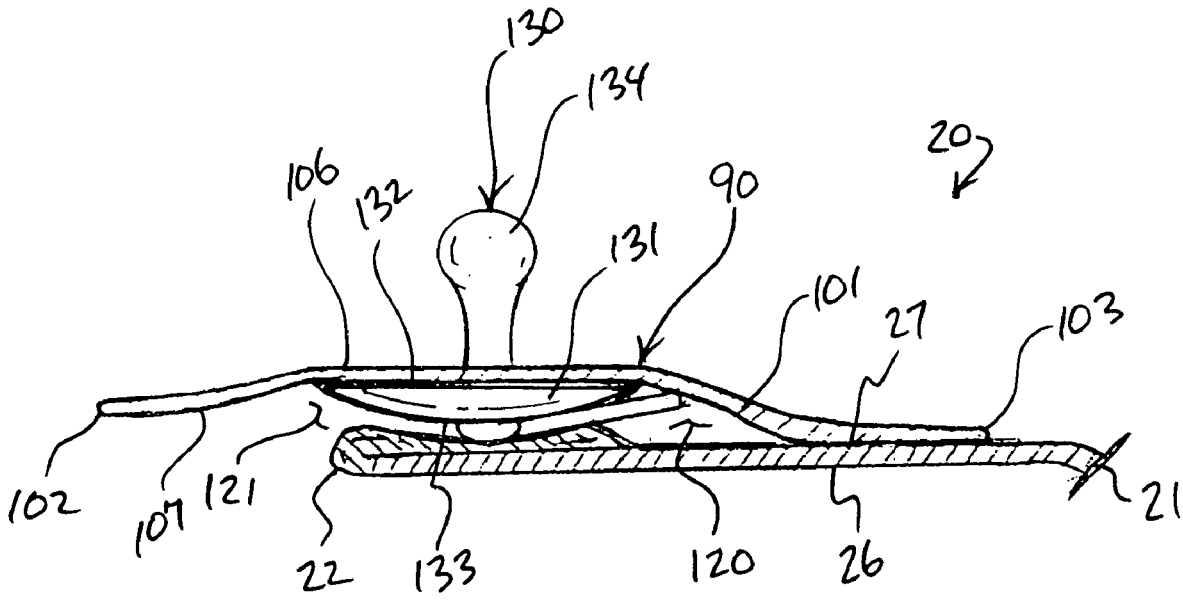
FIG. 6 is a sectional view taken along line 6-6 of FIG. 5.

As seen in FIGS. 1, 3, and 5, pacifier retaining structure 90 consists of a pacifier retaining flap 101 having opposed upper and lower edges 102 and 103, opposed side edges 104 and 105, an outer surface 106, and, as viewed in FIGS. 4 and 6, an opposed inner surface 107. Outer and inner surfaces faces 106 and 107 are opposed, coextensive major faces of flap 101. As viewed in FIGS. 1, 3, and 5, upper edge 102 is substantially parallel relative to lower edge 103, side edge 104 is substantially parallel relative to side edge 105, and upper and lower edges 102 and 103 are substantially parallel relative to side edges 104 and 105. Edges 102-105 each have a length, and cooperate together to form a perimeter 109 of flap 101. In the present embodiment, perimeter 109 is generally rectangular in shape, in which flap 101 is overall generally rectangular in shape. In this respect, the lengths of upper and lower edges 102 and 103 are substantially equal, and the lengths of side edges 104 and 105 are substantially equal and much shorter than the lengths of upper and lower edges 102 and 103 as illustrated.

Flap 101 is formed of soft, pliant woven or unwoven material, such as cotton, polyester, fleece material, silk, or the like or a selected combination of such materials or other similar materials. Flap 101 is attached to blanket 21, is considered an extension of blanket 21, and is considered part of blanket 21.

Flap 101 is applied to inner face 27 of blanket 21 in the present embodiment of the invention. Inner surface 107 of flap 101 faces inner faces 27 of blanket 21, lower edge 103 is applied to inner face 27 of blanket between sleeve 40 and upper edge 22 of blanket 21, and flap 101 extends along inner face 27 of blanket 21 and outboard relative to upper edge 22 of blanket 21 to upper edge 102 of flap 101, which is disposed outboard of upper edge 22 of blanket 21. Side edge 104 of flap 101 is directed toward side edge 24 of blanket 21, and side edge 105 of flap 101 is directed toward side edge 25 of blanket 21 as viewed in FIG. 1. Lower edge 103 of flap 101 and approximately half the length of each of side edges 104 and 105 are affixed to inner face 27 of blanket 21 with stitching denoted at 110, although a suitable adhesive may be used, if desired, heat-bonding, etc. A pocket 120, denoted in FIGS. 4 and 6, is formed in pacifier retaining structure 90, which, in the present embodiment, is formed between inner face 27 of blanket 21 and inner surface 107 of flap 101. Pocket 120 extends from side edge 104 of flap 101 to side edge 105 of flap 101, and from lower edge 103 of flap 101 to upper edge 22 of blanket 21 between upper and lower edges 102 and 103 of flap 101. An opening 121 into pocket 120 from inner face 27 of blanket 21 is also formed in pacifier retaining structure 90, and in this instance is formed between upper edge 22 of blanket 21 and inner surface 107 of flap 101, and extends from adjacent to side edge 105 of flap 101 to side edge 105 of flap 101. Flap 101, and pocket 120 and opening 121 formed between upper edge 22 of blanket 21 and sleeve 40, are parallel relative to sleeve 40, oppose sleeve 40 and extend between proximal and distal ends 60 and 61 of sleeve 40, according to the principle of the invention.

Referencing FIGS. 1, 3, and 5, a plurality of equally spaced-apart openings 123 are formed through flap 101, which are arranged in a row 124 between upper and lower edges 102 and 103 of flap 101. Row 124 of openings 123 extends from adjacent to side edge 104 to adjacent to side edge 105, opposes and is disposed proximate to upper edge 22 of blanket 21, and is substantially parallel relative to sleeve 40 and to upper edge 22 of blanket 21. Openings 123 each extend through flap 101 from outer surface 106 to inner surface 107 opposing inner face 27 of blanket 21, and communicate with pocket 101 formed between inner surface 107 of flap 101 and inner face 27 of blanket 21. In the present embodiment there are five openings 123, and less or more may be employed in other embodiments as may be desired.

As previously mentioned, pacifier retaining structures 90 relating to sleeve 40 is adapted to receive and retain a pacifier relative to blanket 21. In FIG. 6 there is seen a conventional and well-known and readily available pacifier 130 consisting of a broad pacifier base or body 131 having opposed inner and outer faces 132 and 133, and a nipple 134 attached to body 131, which extends outwardly and away from inner face 132 of body 131. To apply pacifier 130 to pacifier retaining structure 90 in accordance with the principle of the invention, pacifier 130 is taken up, such as by hand, and is inserted into pocket 120 through opening 121 directing outer face 133 toward inner face 27 of blanket 21 and inner face 132 toward inner surface 107 of flap 101. Nipple 134 is, in turn, directed into and through one of openings 123, as viewed in FIG. 5, in which nipple 134 projects away from inner face 27 of blanket 21 and outer surface 106 of flap 101 so as to be easily taken in by mouth. In FIG. 5 nipple 134 is directed through the central one of openings 123, and yet pacifier 130 may be located elsewhere in pocket 120 for locating nipple 134 relative whichever one of openings 123 one may desire along the length of flap 101 from side edge 104 to side edge 105, in accordance with the principle of the invention.

Figure 2:
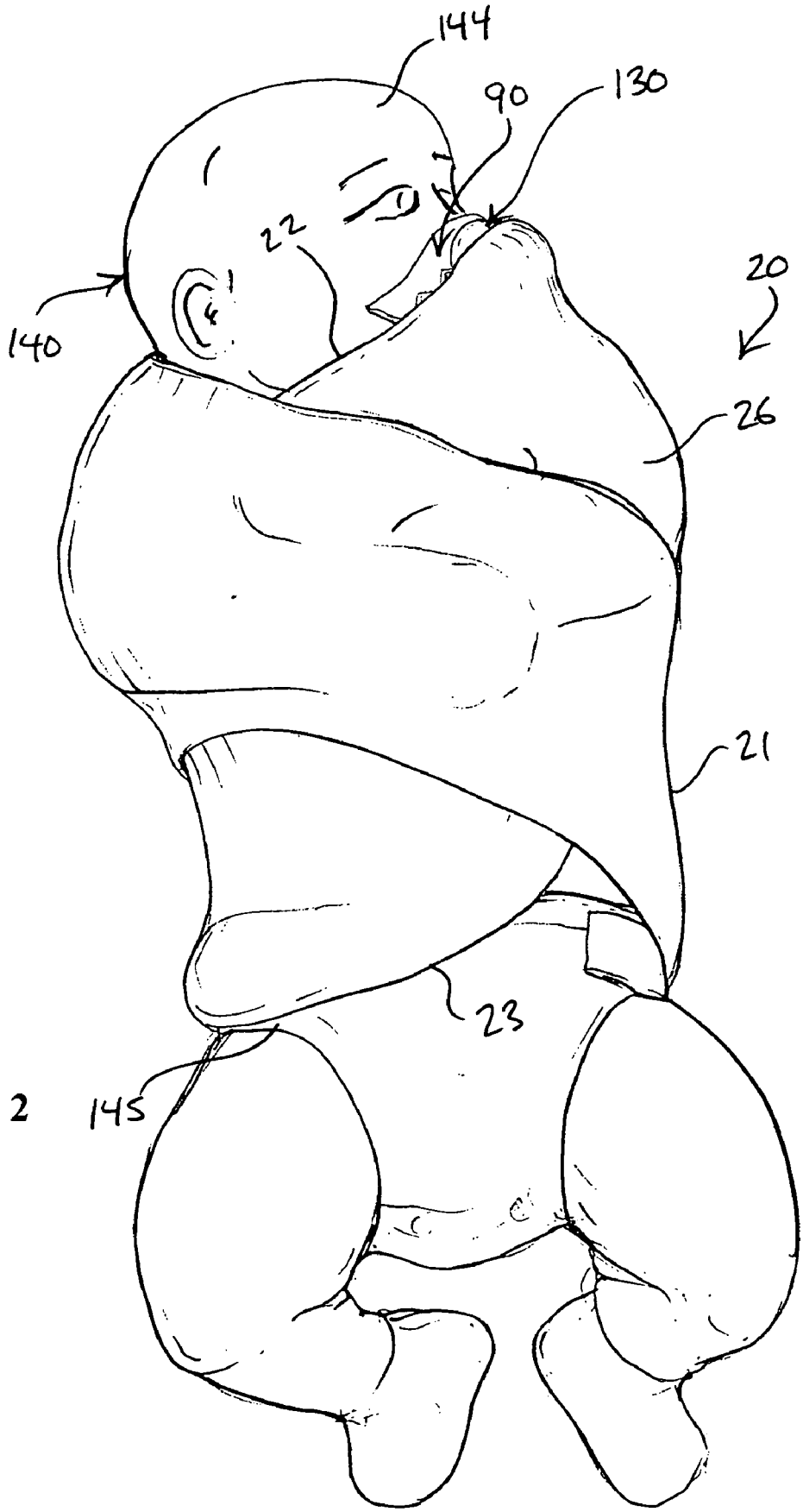
FIG. 2 is a perspective view of a baby swaddled with the swaddling article of FIG. 1.
Figures 7, 8:
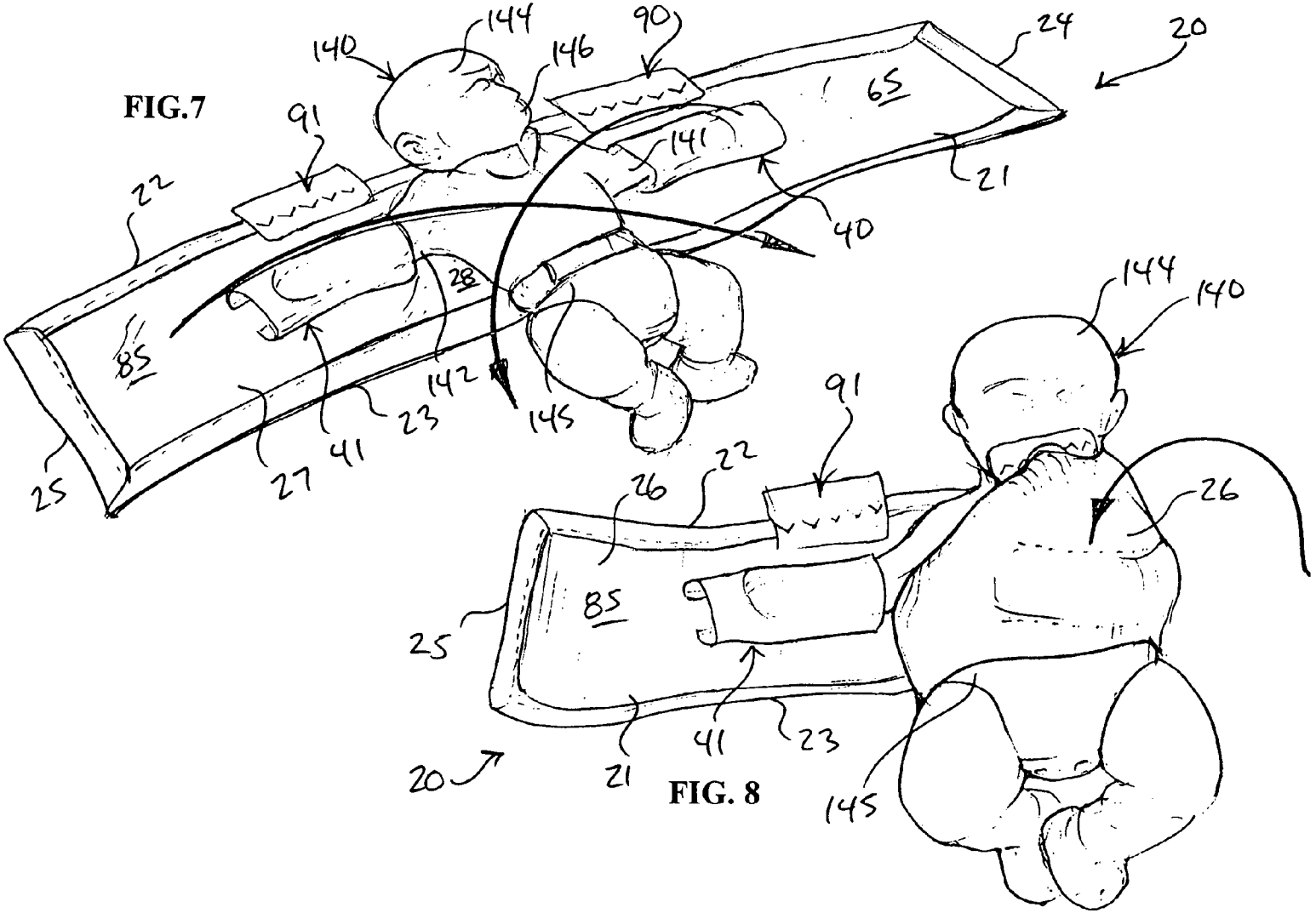
FIG. 7 is a perspective view of a baby initially positioned relative to the swaddling article of FIG. 1.
FIG. 8 is a perspective view of the baby of FIG. 7 shown partially swaddled by the swaddling article.

Swaddling article 20 is used to swaddle a baby, such as baby 140 illustrated in FIGS. 2, 7, and 8. As a matter of reference and understanding, baby 140 is generally representative of a human baby ranging in age from newborn to approximately three to four months of age. To swaddle baby 140, swaddling article 20 laid out flat onto a supporting surface, such as the surface of a bed or changing table or floor or other selected supporting surface, directing outer surface 26 against the supporting surface directing inner face 27 of blanket 21 outwardly and upwardly as illustrated in FIG. 7. Next, baby 140 is carefully taken up, such as by the hands of parent or caregiver, and is laid back first against body-receiving area 28 of inner face 27 of blanket 21 between proximal ends 60 and 80 of sleeves 40 and 41, in which head 143 of baby 140 extends upwardly relative to upper edge 22 of blanket 21 and waist 144 of baby 140 is located along lower edge 23 of blanket 21 such that the baby's legs extend downwardly and away from lower edge 23 of blanket 21. Body-receiving area 28 of inner face 27 formed between proximal ends 60 and 80 of sleeves 40 and 41 is sufficiently large to accommodate baby 140 between proximal ends 60 and 80 of sleeves 40 and 41. At this point, left arm 141 of baby 140 is inserted into sleeve 40 through proximal end 60, and right arm 142 of baby 140 is inserted into sleeve 41 through proximal end 80. As viewed in FIG. 7, sleeves 40 and 41 are each sufficiently long so as to prevent the hands of baby 140 from extending outwardly from distal ends 61 and 81 of sleeves 40 and 41, respectively.

To complete the swaddling process in this particular example with reference to FIG. 8, flap 65 formed proximate side edge 24 of blanket 21 is taken up and snuggly wrapped over the front of baby 140 drawing inner face 27 of blanket 21 extending from proximate area 28 to side edge 24 across baby's 140 chest and belly between baby's 140 head 143 and waist 144 and flap 65 is tucked underneath the back of baby 140 between the back of baby 140 and body-receiving area 28 of inner face 27 of blanket 21, in which the chest and belly of baby 140 is covered by blanket 21 from his head 143 to his waist 144 and left arm 141 (FIG. 7) of baby 140 is, in turn, drawn across the front of baby 140. In FIG. 8 it is seen that blanket 21 extends along the front of baby 140 from upper edge 22 drawn along the bottom of baby's 140 head 144 to lower edge 23 drawn along baby's 140 waist 145, in which the location of pacifier retaining structure 90 as herein specifically described is such that it is, in turn, drawn across the region of baby's mouth 146 referenced in FIG. 7, in accordance with the principle of the invention. By tucking in flap 65 underneath the back of baby 140 between the back of baby 140 and body-receiving area 28 of inner face 27 of blanket 21, left arm 141 of baby 140 held in sleeve 40 is restrained across the front of baby 140 in turn locating pacifier retaining structure 90 along the region of baby's 140 mouth 146.

At this point, flap 85 formed proximate side edge 25 of blanket 21 is taken up and snuggly wrapped over the front of baby 140 drawing inner face of blanket 21 extending from proximate area 28 to side edge 25 across baby's 140 chest and belly across blanket 21 previously snuggly wrapped about baby 140 and flap 85 is tucked underneath the back of baby 140 along outer face 26 of blanket 21 extending across the baby's 140 back, in which the chest and belly of baby 140 already covered by blanket 21 is again covered by blanket 21 and right arm 142 of baby 140 is, in turn, drawn across the front of baby 140 relative to baby's 140 left arm 141 thereby swaddling baby 140 as illustrated in FIG. 2. By tucking in flap 85 underneath the back of baby 140, right arm 142 of baby 140 held in sleeve 40 is restrained across the front of baby 140 relative to baby's left arm 141. To un-swaddle baby 140, the foregoing operation described to swaddle baby 140 need only be reversed.

Because the location of pacifier retaining structure 90 as herein specifically described is such that it is drawn across the region of baby's mouth 146 (FIG. 7) when baby 140 is swaddled with swaddling article 20 as herein described, a pacifier, such as pacifier 130, received and retained by pacifier retaining structure 90 as previously described not only retains pacifier 130 preventing it from falling away from blanket 21, but also presents nipple 134 (illustrated only in FIGS. 5 and 6) of pacifier 130 relative to baby's mouth 146 allowing baby 140 to take in nipple 134 of pacifier 130 by mouth at will. Should baby 140 spit out nipple 134 of pacifier 130 received and retained by pacifier retaining structure 90, the provision of pacifier retaining structure 90 retaining pacifier 130 relative to blanket 21 inhibits pacifier 130 from dislodging and falling away from blanket 21, in accordance with the principle of the invention. Also, the soft, pliant characteristic of flap 101 provides a comfortable, soft presentation against the region of the baby's mouth 146.

Openings 123 extending in row 124 across flap 101 of pacifier retaining structure 90 from side edge 104 of flap 101 to side edge 105 of flap 101 define different pacifier receiving locations of pacifier retaining structure 90 across flap 101 from side edge 104 to side edge 105. The different pacifier receiving locations defined by openings 123 accommodates babies of varying sizes and subtle variations in how a parent or caregiver may swaddle a baby with swaddling article 140, and allows a parent or caregiver the freedom to locate a pacifier relative to any one of openings 123 across the length of flap 101 for locating the pacifier at various locations along the length of flap 101 from side edge 104 to side edge 105 for ensuring the pacifier is registered relative to the baby's mouth when the baby is swaddled by swaddling article 20, in accordance with the principle of the invention.

As previously mentioned, pacifier retaining structure 91 is identical in every respect to pacifier retaining structure 91. Accordingly, to utilize pacifier receiving structure 91 in the same manner as pacifier receiving structure 90 baby 140 may be swaddled by first wrapping flap 85 about baby 140 and then flap 65, thereby presenting pacifier retaining structure 91 relative to baby's 140 mouth 146. Furthermore, because sleeves 40 and 41 are each sufficiently long so as to prevent the hands of baby 140 from extending outwardly from distal ends 61 and 81 of sleeves 40 and 41, respectively, baby 140 is prevented from scratching himself with his fingernails while swaddled with swaddling article 20.

After being swaddled with swaddling article 20, it is to be noted that the bottom and legs of baby 140 remain unrestrained as clearly illustrated in FIG. 2. As a result, the baby's 140 diaper may be easily changed as needed without having to un-swaddle baby 140 from swaddling article 20, in accordance with the principle of the invention.

In swaddling baby 140 with swaddling article 20, flap 65 may be tucked under baby's 140 right arm 142 or over baby's 140 right shoulder. Should flap 85 be tucked first, flap 85 may be tucked under baby's 140 left arm 141 or over baby's 140 left shoulder.

Figure 9:
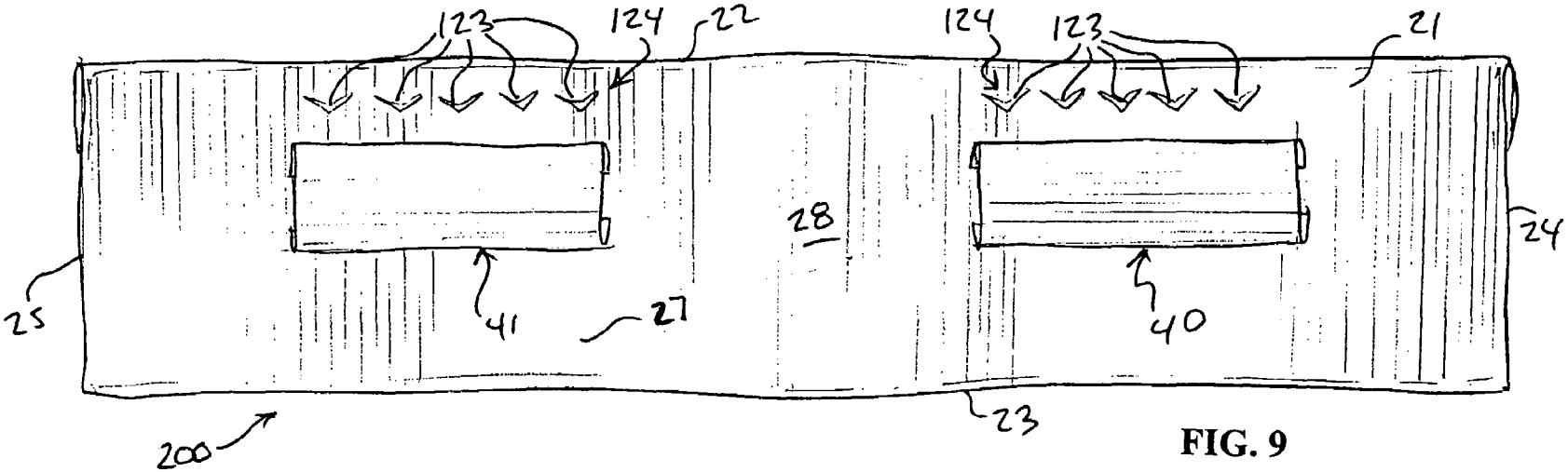
FIG. 9 is a front plan view of a swaddling article constructed and arranged in accordance with an alternate embodiment of the invention.
Figure 10:
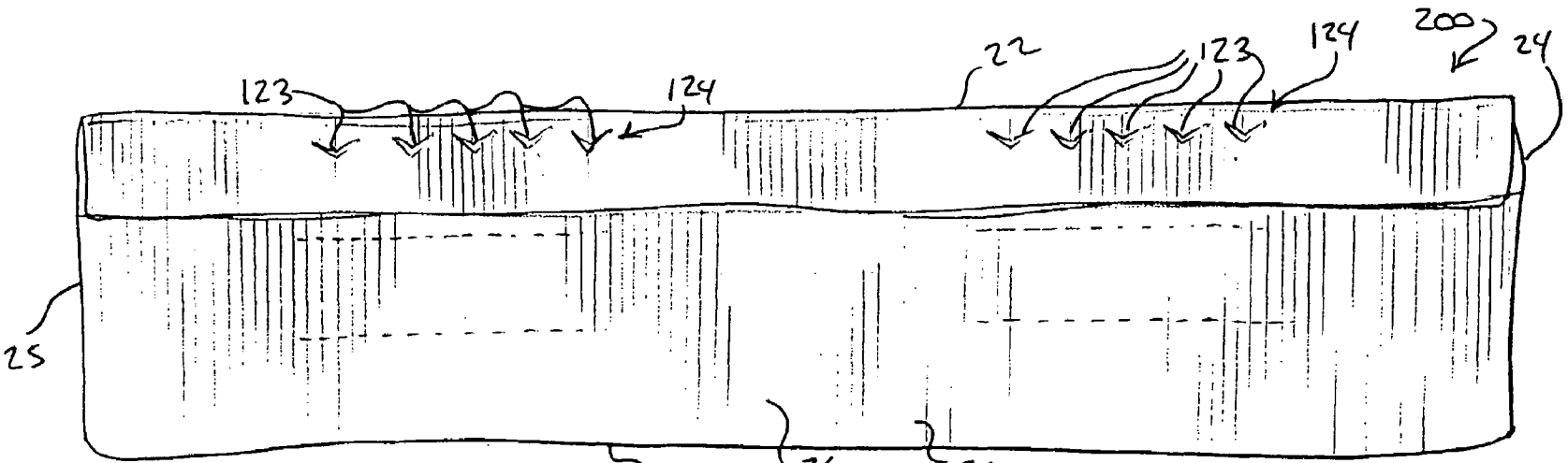
FIG. 10 is a rear plan view of the swaddling article of FIG. 9.
Figure 11:
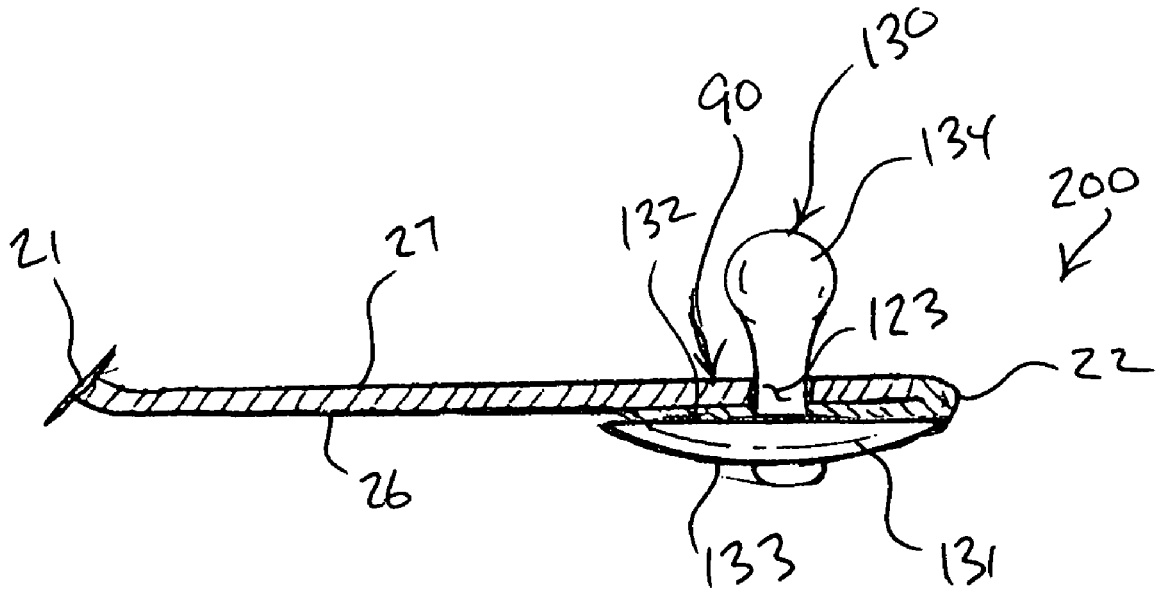
FIG. 11 is a fragmented vertical sectional view of the swaddling article of FIG. 9 illustrating a pacifier held by the swaddling article.

The invention has been described above with reference to a preferred embodiment, and those having regard for the art will readily appreciate that an exemplary swaddling article 20 is disclosed, which is easy to use, easy to construct, and in use provides for the efficient swaddling of a baby and efficiently retains a pacifier relative to the baby's mouth, which may be taken by the baby by mouth at will. Those skilled in the art will recognize that changes and modifications may be made to the embodiment without departing from the nature and scope of the invention. As a matter of example, FIGS. 9 and 10 illustrate front and rear plan views, respectively, of a swaddling article 200 constructed and arranged in accordance with an alternate embodiment of the invention. In common with swaddling article 20, swaddling article 200 shares blanket 21 including upper edge 22, lower edge 23, side edges 24 and 25, outer face 26 (FIG. 10), inner face 27 (FIG. 9), area 28 (FIG. 9), and sleeves 40 and 41. In the embodiment of swaddling article 200, rows 124 of openings 123 of pacifier retaining structures 90 and 91, although positioned relative to sleeves 40 and 41 in exactly the same manner as with swaddling article 20, row 124 of openings 123 relating to sleeve 40 are formed through blanket 21 from outer face 26 (FIG. 10) to inner face 27 (FIG. 9) between upper edge 22 and sleeve 40, and row 124 of openings 123 relating to sleeve 41 are formed through blanket 21 from outer face 26 (FIG. 10) to inner face 27 (FIG. 9) between upper edge 22 and sleeve 41. In the present embodiment, pacifier retaining structures 90 and 91 lack pockets. To retain a pacifier, such as pacifier 130, pacifier 130 is simply received and held by one of openings 123. In particular, and with respect to each opening 123 of pacifier retaining structures 90 and 91 of swaddling article 200 as illustrated in FIG. 11, pacifier 130 is taken up, such as by hand, and nipple 134 is inserted through the selected opening 123 from outer face 26 of blanket 21 to inner face 27 of blanket 21 bringing inner face 132 of body 131 against outer face 26 of blanket 21, in which nipple 134 extends through and is retained by the designated opening 123 and projects outwardly away from inner face 27 of blanket 21 so as to be easily taken in by mouth. Other than the designated differences between the pacifier retaining structures of swaddling articles 20 and 200, the use and function of swaddling article 200 is identical in every respect to swaddling article 20.

There are some pacifiers that have a handle that is attached to and extends rearwardly relative to the pacifier base or body. One such pacifier is offered under the exemplary SOOTHIE® trademark, and there may be others. The SOOTHIE® pacifier, as a matter of example, is a premium pacifier designed for newborns and babies without teeth who are successfully bottle or breastfeeding. The SOOTHIE® pacifier has a one-piece construction adheres to the American Academy of Pediatrics guidelines. If desired, the outer face of the base of such a pacifier or other similar pacifier may be presented against inner face 27 of blanket 21 of swaddling article 200 and the handle thereof passed into and through one of openings 123, relating either to pacifier structure 90 or pacifier structure 91 as may be desired, so as to retain the pacifier relative to blanket 21 of swaddling article 200, in accordance with the principle of the invention.

Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. An article for swaddling a baby, comprising:

a soft, pliant blanket having opposed upper and lower edges, opposed first and second side edges, an outer face and an opposed inner face defining a body-receiving area between the first and second side edges of the blanket extending from the upper edge of the blanket to the lower edge of the blanket;

the blanket formed with opposed, spaced apart first and second arm-receiving sleeves;

the first arm-receiving sleeve disposed between the opposed upper and lower edges of the blanket and between the body-receiving area of the inner face of the blanket and the first side edge of the blanket;

the second arm-receiving sleeve disposed between the opposed upper and lower edges of the blanket and between the body-receiving area of the inner face of the blanket and the second side edge of the blanket;

a pacifier retaining structure formed in the blanket adjacent to the upper edge of the blanket opposing the first arm-receiving sleeve and positioned between the body-receiving area and the first side edge of the blanket, the pacifier retaining structure adapted to receive and operatively hold a pacifier having a nipple so as to retain the pacifier with respect to the blanket leaving the nipple operatively exposed in preparation for use with respect to the inner face of the blanket;

the blanket extending from the first side edge to proximate to the body-receiving area to wrap over a baby positioned on the inner face of the body-receiving area of the blanket to draw the inner face of the blanket between the first side edge of the blanket and the body-receiving area of the blanket, the first arm-receiving sleeve, and the pacifier-retaining structure across the body-receiving area; and the blanket extending from the second side edge to proximate to the body-receiving area to wrap over a baby positioned on the inner face of the body-receiving area of the blanket to draw the inner face of the blanket between the second side edge of the blanket and the body-receiving area of the blanket, and the second arm-receiving sleeve across the body-receiving area.

2. The article according to claim 1, wherein the first arm-receiving sleeve is substantially parallel relative to the upper edge of the blanket.

3. The article according to claim 2, wherein the second arm-receiving sleeve is substantially parallel relative to the upper edge of the blanket.

4. The article according to claim 3, further comprising:

the first arm-receiving sleeve having a first proximal end directed toward the body-receiving area of the inner face of the blanket, and a first distal end directed toward the first side edge of the blanket; and a first flap of the blanket extending from the first distal end of the first arm-receiving sleeve to the first side edge of the blanket.

5. The article according to claim 4, further comprising:

the second arm-receiving sleeve having a second proximal end directed toward the body-receiving area of the inner face of the blanket, and a second distal end directed toward the second side edge of the blanket; and a second flap of the blanket extending from the second distal end of the second arm-receiving sleeve to the second side edge of the blanket.

6. The article according to claim 5, further comprising a pacifier including a nipple, and the pacifier retained by the pacifier retaining structure operatively holding the nipple extending away from the inner face of the blanket in preparation for use.

7. An article for swaddling a baby, comprising:

a soft, pliant blanket having opposed upper and lower edges, opposed first and second side edges, an outer face and an opposed inner face defining a body-receiving area between the first and second side edges of the blanket extending from the upper edge of the blanket to the lower edge of the blanket;

the blanket formed with opposed, spaced apart first and second arm-receiving sleeves;

the first arm-receiving sleeve disposed between the opposed upper and lower edges of the blanket and between the body-receiving area of the inner face of the blanket and the first side edge of the blanket;

the second arm-receiving sleeve disposed between the opposed upper and lower edges of the blanket and between the body-receiving area of the inner face of the blanket and the second side edge of the blanket;

a first pacifier-receiving opening formed through the blanket defining a pacifier-receiving point, wherein the first pacifier-receiving opening defining the pacifier-receiving point is adapted to receive and operatively hold a pacifier having a nipple so as to retain the pacifier with respect to the blanket leaving the nipple operatively exposed in preparation for use with respect to the inner face of the blanket, is positioned between the upper edge of the blanket and the first arm-receiving sleeve, opposes the first arm-receiving sleeve, and is positioned between the body-receiving area and the first side edge of the blanket;

the blanket extending from the first side edge to proximate to the body-receiving area to wrap over a baby positioned on the inner face of the body-receiving area of the blanket to draw the inner face of the blanket between the first side edge of the blanket and the body-receiving area of the blanket, the first arm-receiving sleeve, and the pacifier-receiving opening defining the pacifier-receiving point across the body-receiving area; and the blanket extending from the second side edge to proximate to the body-receiving area to wrap over a baby positioned on the inner face of the body-receiving area of the blanket to draw the inner face of the blanket between the second side edge of the blanket and the body-receiving area of the blanket, and the second arm-receiving sleeve across the body-receiving area.

8. The article according to claim 7, further comprising:

a pacifier comprising a pacifier body and a nipple attached to, and extending away from, the pacifier body; and the pacifier received and held by the pacifier-receiving opening, and the nipple projects away from the inner face of the blanket in preparation for use.

9. The article according to claim 7, wherein the first arm-receiving sleeve is substantially parallel relative to the upper edge of the blanket.

10. The article according to claim 9, wherein the second arm-receiving sleeve is substantially parallel relative to the upper edge of the blanket.

11. The article according to claim 10, further comprising:

the first arm-receiving sleeve having a first proximal end directed toward the body-receiving area of the inner face of the blanket, and a first distal end directed toward the first side edge of the blanket; and a first flap of the blanket extending from the first distal end of the first arm-receiving sleeve to the first side edge of the blanket.

12. The article according to claim 11, further comprising:

the second arm-receiving sleeve having a second proximal end directed toward the body-receiving area of the inner face of the blanket, and a second distal end directed toward the second side edge of the blanket; and a second flap of the blanket extending from the second distal end of the second arm-receiving sleeve to the second side edge of the blanket.

13. The article according to claim 7, further comprising:

a plurality of spaced-apart pacifier-receiving openings formed through the blanket between the upper edge of the blanket and the first arm-receiving sleeve defining different pacifier-receiving points with respect to the first arm-receiving sleeve; and the first pacifier-receiving opening comprising one of the plurality of spaced-apart pacifier-receiving openings.

14. The article according to claim 13, wherein the plurality of spaced-apart pacifier-receiving openings is formed in a row substantially parallel to the first arm-receiving sleeve.

15. An article for swaddling a baby, comprising:

a soft, pliant blanket having opposed upper and lower edges, opposed first and second side edges, an outer face and an opposed inner face defining a body-receiving area between the first and second side edges of the blanket extending from the upper edge of the blanket to the lower edge of the blanket;

the blanket formed with opposed, spaced apart first and second arm-receiving sleeves;

the first arm-receiving sleeve disposed between the opposed upper and lower edges of the blanket and between the body-receiving area of the inner face of the blanket and the first side edge of the blanket;

the second arm-receiving sleeve disposed between the opposed upper and lower edges of the blanket and between the body-receiving area of the inner face of the blanket and the second side edge of the blanket;

the blanket formed with a pacifier retaining structure comprising a pacifier body-receiving pocket positioned proximate to the upper edge of the blanket opposing the first arm-receiving sleeve, and positioned between the body-receiving area and the first side edge of the blanket;

a first pacifier-receiving opening formed through the pocket from the inner face of the blanket defining a pacifier-receiving point;

the pocket adapted to receive a pacifier body of a pacifier having a nipple and the first pacifier-receiving opening adapted to receive therethrough the nipple of the pacifier extending away from the inner face of the blanket, the pocket and the first pacifier-receiving opening cooperating together to maintain the nipple operatively exposed in preparation for use with respect to the inner face of the blanket;

the blanket extending from the first side edge to proximate to the body-receiving area to wrap over a baby positioned on the inner face of the body-receiving area of the blanket to draw the inner face of the blanket between the first side edge of the blanket and the body-receiving area of the blanket, the first arm-receiving sleeve, and the pacifier-receiving opening defining the pacifier-receiving point formed through the pocket across the body-receiving area; and the blanket extending from the second side edge to proximate to the body-receiving area to wrap over a baby positioned on the inner face of the body-receiving area of the blanket to draw the inner face of the blanket between the second side edge of the blanket and the body-receiving area of the blanket, and the second arm-receiving sleeve across the body-receiving area.

16. The article according to claim 15, further comprising:

a pacifier comprising a pacifier body and a nipple attached to, and extending away from, the pacifier body;

the body disposed in the pacifier body-receiving pocket; and the nipple extending away from the inner face of the blanket through the first pacifier-receiving opening in preparation for use.

17. The article according to claim 15, wherein the first arm-receiving sleeve is substantially parallel relative to the upper edge of the blanket.

18. The article according to claim 17, wherein the second arm-receiving sleeve is substantially parallel relative to the upper edge of the blanket.

19. The article according to claim 18, further comprising:

the first arm-receiving sleeve having a first proximal end directed toward the body-receiving area of the inner face of the blanket, and a first distal end directed toward the first side edge of the blanket; and a first flap of the blanket extending from the first distal end of the first arm-receiving sleeve to the first side edge of the blanket.

20. The article according to claim 19, further comprising:

the second arm-receiving sleeve having a second proximal end directed toward the body-receiving area of the inner face of the blanket, and a second distal end directed toward the second side edge of the blanket; and a second flap of the blanket extending from the second distal end of the second arm-receiving sleeve to the second side edge of the blanket.

21. The article according to claim 15, further comprising:

a plurality of spaced-apart pacifier-receiving openings formed through the pocket from the inner face of the blanket defining different pacifier-receiving points with respect to the first arm-receiving sleeve; and the first pacifier-receiving opening comprising one of the plurality of spaced-apart pacifier-receiving openings.

22. The article according to claim 21, wherein the plurality of spaced-apart pacifier-receiving openings is formed in a row substantially parallel to the first arm-receiving sleeve.

* * * * *